US008257138B2

(12) United States Patent
Smith

(10) Patent No.: US 8,257,138 B2
(45) Date of Patent: Sep. 4, 2012

(54) ATHLETIC BRA

(76) Inventor: Cynthia A Smith, Red Bank, NJ (US)

( * ) Notice: Subject to any disclaimer, the term of this patent is extended or adjusted under 35 U.S.C. 154(b) by 330 days.

(21) Appl. No.: 12/717,416

(22) Filed: Mar. 4, 2010

(65) Prior Publication Data

US 2011/0217904 A1 Sep. 8, 2011

(51) Int. Cl.
*A41C 3/00* (2006.01)

(52) U.S. Cl. ..... 450/74; 450/75; 450/76

(58) Field of Classification Search ..... 450/19–21, 450/58, 79, 65–76, 80, 82, 85, 92, 93
See application file for complete search history.

(56) References Cited

U.S. PATENT DOCUMENTS

| | | | | |
|---|---|---|---|---|
| 3,010,456 | A | 11/1961 | Young | |
| 3,110,313 | A * | 11/1963 | Plehn | 450/19 |
| 3,896,818 | A * | 7/1975 | Locascio | 450/70 |
| 4,217,905 | A * | 8/1980 | Atwater et al. | 450/74 |
| 4,254,777 | A | 3/1981 | Johnston | |
| 4,289,137 | A * | 9/1981 | Dell et al. | 450/58 |
| 4,340,064 | A * | 7/1982 | Vale | 450/72 |
| 4,458,684 | A * | 7/1984 | Frankel | 450/53 |
| 4,538,614 | A * | 9/1985 | Henderson | 450/70 |
| 4,781,651 | A * | 11/1988 | Ekins | 450/79 |
| 4,804,351 | A * | 2/1989 | Raml et al. | 450/58 |
| 4,816,005 | A | 3/1989 | Braaten | |
| 5,643,043 | A * | 7/1997 | Pflum | 450/86 |
| 6,287,168 | B1 * | 9/2001 | Rabinowicz | 450/75 |
| 6,685,534 | B2 * | 2/2004 | Mitchell et al. | 450/74 |
| 7,163,432 | B2 * | 1/2007 | Mitchell et al. | 450/65 |
| 7,435,155 | B2 | 10/2008 | Reinisch | |
| RE41,654 | E | 9/2010 | Struble | |
| 7,938,711 | B1 | 5/2011 | Johnston | |
| 8,075,368 | B2 * | 12/2011 | Puyaubreau | 450/65 |
| 8,137,155 | B2 * | 3/2012 | Horii et al. | 450/75 |
| 2006/0009124 | A1 | 1/2006 | Falla | |
| 2007/0010165 | A1 | 1/2007 | Yudkoff | |
| 2008/0003922 | A1 | 1/2008 | Hori | |
| 2008/0070477 | A1 | 3/2008 | Barbour | |
| 2008/0287036 | A1 | 11/2008 | McGuire | |
| 2009/0081924 | A1 | 3/2009 | Puyaubreau | |
| 2009/0098803 | A1 | 4/2009 | Reinisch | |
| 2009/0233522 | A1 | 9/2009 | Schlatmann | |
| 2011/0081827 | A1 | 4/2011 | Williams | |
| 2011/0104985 | A1 | 5/2011 | Linder | |
| 2011/0117818 | A1 | 5/2011 | Barnard | |
| 2011/0130072 | A1 | 6/2011 | Lander | |

* cited by examiner

*Primary Examiner* — Gloria Hale

(74) *Attorney, Agent, or Firm* — Foley & Lardner LLP; John D. Lanza

(57) ABSTRACT

A bra to be worn during vigorous physical activity. It provides the wearer with a high level of breast tissue support without undue restriction of breathing or shoulder movement, while providing means for ventilation and moisture management. The bra is underwire-free, and designed to be worn as outerwear. The bra achieves these objectives through the innovative combination of various non-stretch and stretch fabrics. The non-stretch portions of the garment provide a high level of compression and stability to the breast tissue, while the multiple regions of stretch fabric minimize breathing and shoulder restrictions and provide ventilation. Non-stretch wicking fabric is used to form the majority of the body of the bra, and is used to pull the breast tissue in and hold it firmly to the chest. This non-stretch fabric is connected to panels of stretch wicking fabric located in the front and back of the body of the bra.

16 Claims, 5 Drawing Sheets

ATHLETIC BRA

STATEMENT REGARDING FEDERALLY SPONSORED RESEARCH OR DEVELOPMENT

Not Applicable

CROSS-REFERENCE TO RELATED APPLICATIONS

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

An outerwear bra to be worn by women during vigorous physical activity to maximize motion control of the breast tissue while minimizing breathing restriction and maximizing heat and moisture management.

2. Background of the Invention

In order for many women to fully participate in vigorous sports, including endurance sports such as running and triathlon, they must wear a garment that provides them with a high level of breast tissue support. Without sufficient support, many women athletes experience physical pain as well as permanent damage to breast tissue.

However, garments providing a high level of support to the breast tissue, especially for those women with breasts of a C-cup or higher, often restrict movement of the shoulders and restrict breathing, which can influence both comfort and performance. Furthermore, these garments are frequently constructed from multiple layers of thick fabric with little or no ventilation, which can result in overheating, excessive sweating and painful chafing. Additionally, many such garments for larger breasted women are not designed to be worn as outerwear, requiring these women to wear additional layers of clothing, resulting in further heat and moisture management problems. Finally, some garments employ underwire to provide support to the breast tissue, which can uncomfortably poke and pinch sensitive tissues during strenuous activities.

With the increasing popularity of road races and triathlons, and the increase in the average cup size of the American woman to a 36C, underwire-free outerwear garments that provide female athletes with sufficient breast support, ventilation and moisture management without undue restrictions on movement or breathing are integral to women's successful participation in sports.

BRIEF SUMMARY OF THE INVENTION

The object of the present invention is to provide female athletes with an underwire-free outerwear athletic bra that provides a high level of breast tissue support without undue restriction of breathing or shoulder movement, while providing means for ventilation and moisture management. These objects are achieved through the innovative combination of various non-stretch and stretch fabrics. The non-stretch portions of the garment provide a high level of compression and stability to the breast tissue, while the multiple regions of stretch fabric minimize breathing and shoulder restrictions and provide ventilation.

In the present invention, non-stretch wicking fabric is used to form the majority of the body of the bra, and is used to pull the breast tissue in and hold it firmly to the chest. This non-stretch fabric is connected to panels of stretch wicking fabric located in the front and back of the body of the bra. These panels allow the otherwise rigid body of the bra to expand horizontally with the chest as the wearer inhales and exhales. Through the use of stretch mesh fabric for the back and/or front panels of the bra, a high degree of ventilation and moisture management can be achieved without sacrificing motion control.

In one aspect, the invention provides a bra comprising two shoulder straps, a body configured to contact a wearer's torso, and a rib band, wherein said shoulder straps are connected to the body, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material, and wherein the right edge of the front center panel and the left edge of the back center panel are connected to one another by one or more contiguous fabric pieces constructed of non-stretch material.

In another aspect, the invention provides a bra comprising two shoulder straps, a body configured to contact a wearer's torso, and a rib band, wherein said shoulder straps are connected to the body, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material, and wherein the right edge of the front center panel and the left edge of the back center panel are connected to one another by one or more contiguous fabric pieces constructed of non-stretch material, wherein the border between stretch fabric pieces and non-stretch fabric pieces is irregular.

Other configurations, features and advantages of the invention will be, or will become, apparent to one with skill in the art upon examination of the following figures and detailed description. It is intended that all such additional configurations, features and advantages included within this description and this summary, be within the scope of the invention, and be protected by the following claims.

BRIEF DESCRIPTION OF THE DRAWINGS

The present invention can be understood more clearly with reference to the following drawings and description. The components in the drawings are not necessarily to scale, emphasis is instead placed on illustration of the principles of the invention. In the drawings.

DETAILED DESCRIPTION

Figure 1:
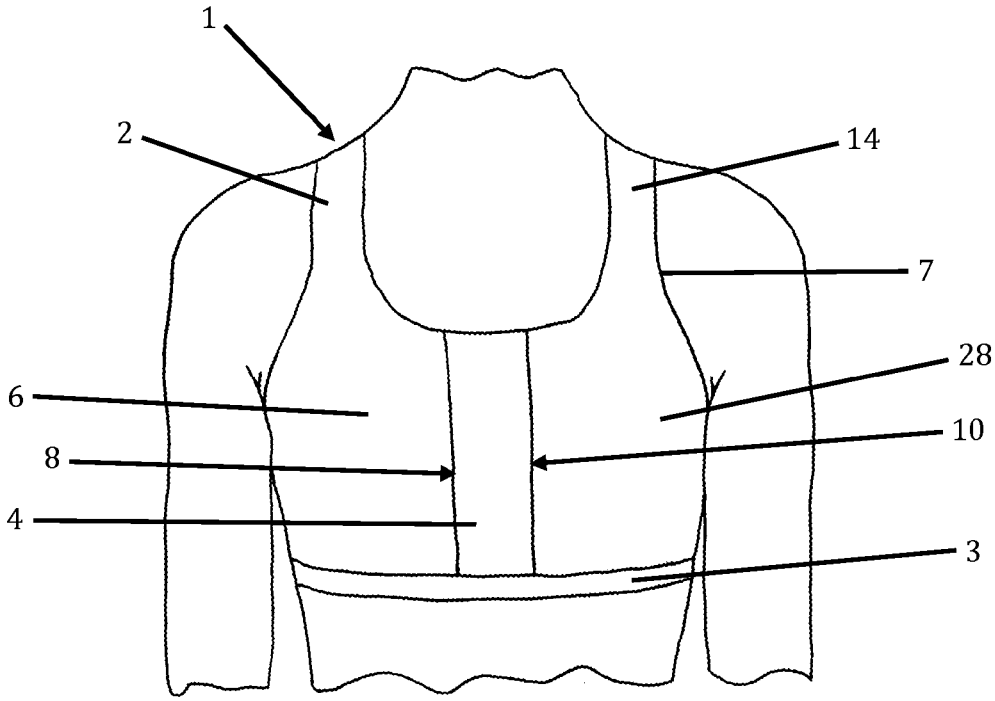
FIG. 1 is a front elevational view of a bra in accordance with a first embodiment of the present invention shown on the wearer.
Figure 2:
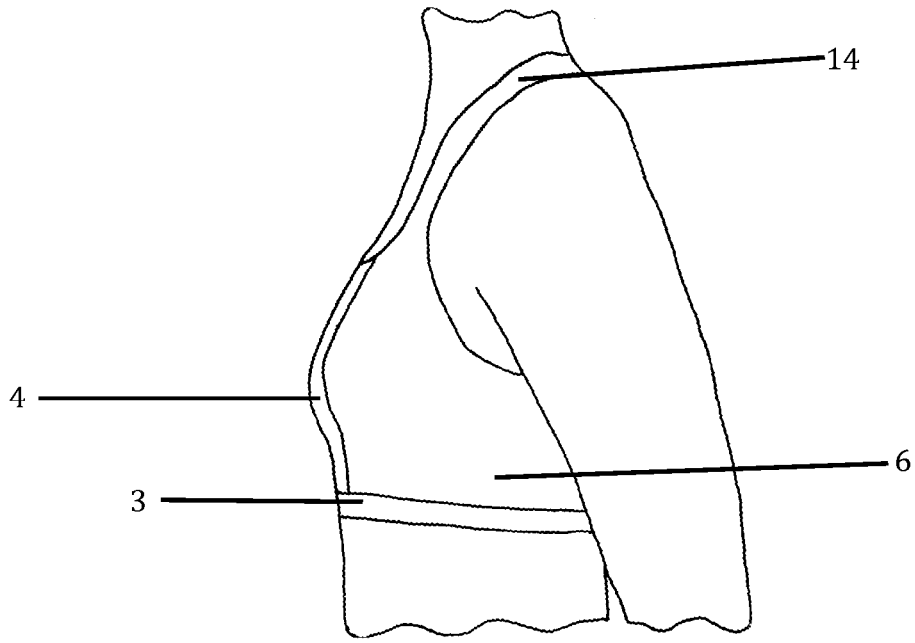
FIG. 2 is a side elevational view of the bra according to FIG. 1.
Figure 3:
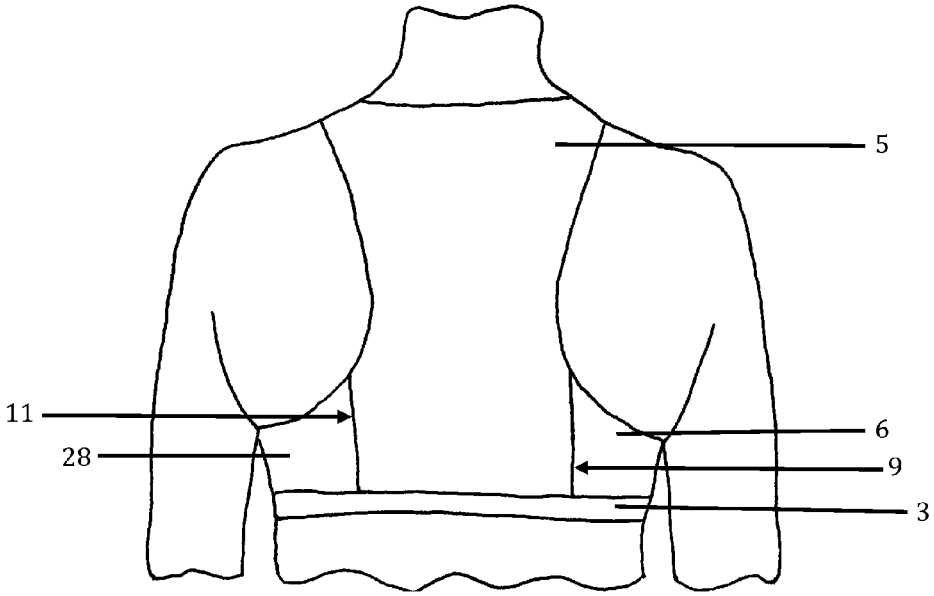
FIG. 3 is a rear elevational view of the bra according to FIG. 1.
Figure 4:
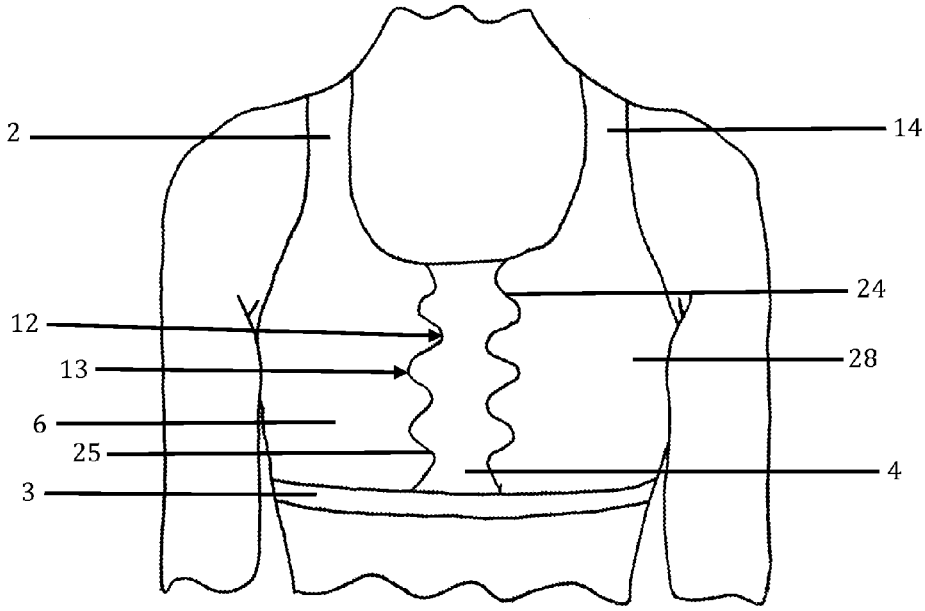
FIG. 4 is a front elevational view of a bra in accordance with a second embodiment of the present invention shown on the wearer.
Figure 5:
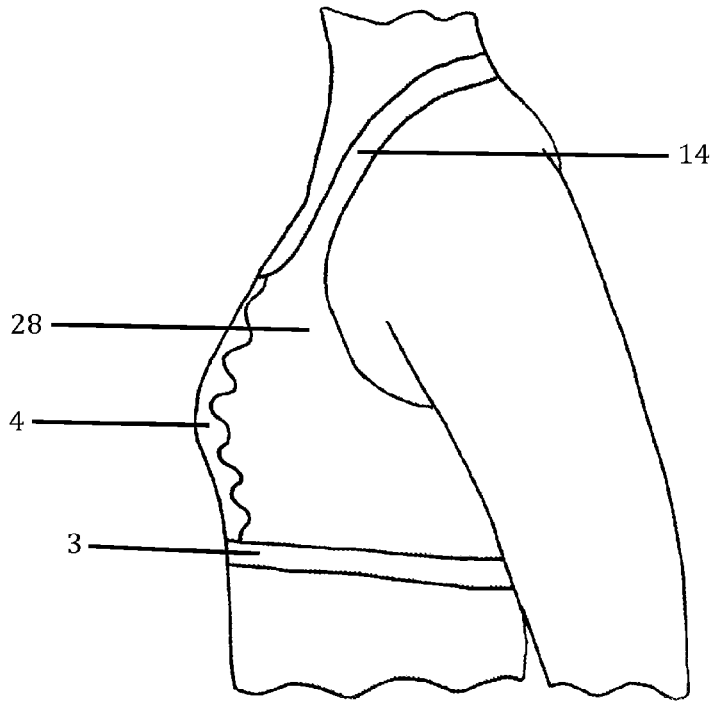
FIG. 5 is a side elevational view of the bra according to FIG. 4.
Figure 6:
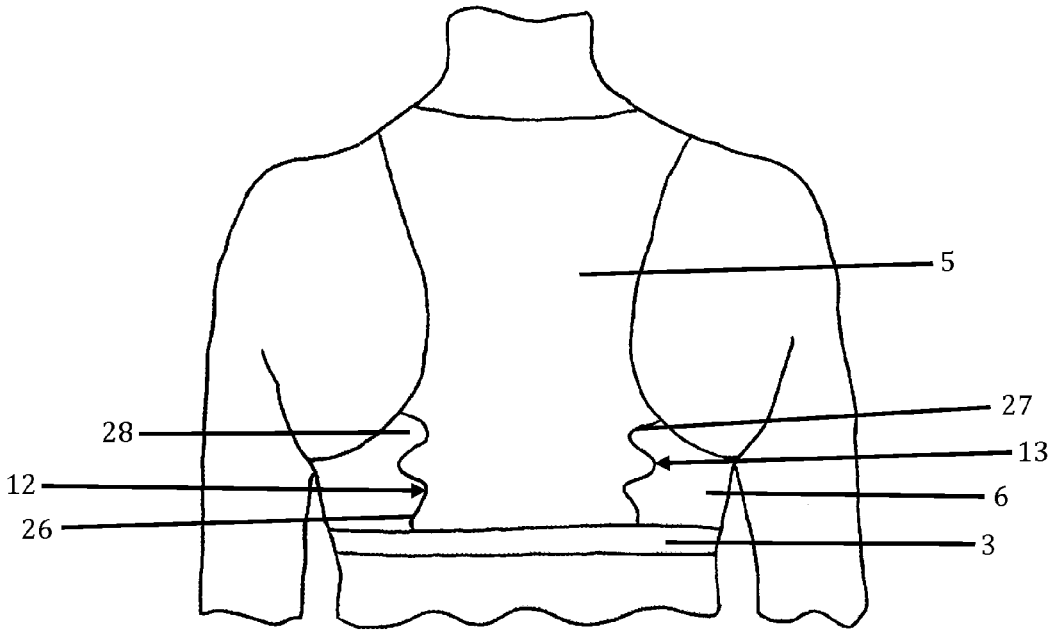
FIG. 6 is a rear elevational view of the bra according to FIG. 4.

Bra 1 comprises two shoulder straps 2 and 14, a body 7 configured to contact a wearer's torso and a rib band 3. The shoulder straps 2 and 14 are connected to the body 7. The rib band 3 is associated with the body 7. The body 7 is comprised of a front center panel 4, a back center panel 5 and one or more fabric pieces 6 and 28 connecting the front center panel 4 and the back center panel 5. Specifically, the left edge 8 of the front center panel 4 and the right edge 9 of the back center panel 5 are connected to one another by one or more fabric pieces 6, and the right edge 10 of the front center panel 4 and the left edge 11 of the back center panel 5 are connected to one another by one or more fabric pieces 28.

The fabric pieces 6 and 28 connecting the front center panel 4 and the back center panel 5 are constructed of non-stretch material. It is understood by those with ordinary skill in the art that a "non-stretch material" is a material with no elastic components such that any limited stretch exhibited by the fabric is a result of mechanical movement in the weave of the fabric. The front center panel 4 and back center panel 5 are constructed of a stretch material. It is understood by those with ordinary skill in the art that the spandex content of the stretch material affects the level of support of the bra, with a higher spandex content corresponding to a higher recovery power, with a higher recovery power requiring more energy to pull apart, thereby providing a greater amount of support.

In other embodiments of the present invention, the borders 24, 25, 26 and 27 between front center panel 4 and the plurality of fabric pieces 6 and 28 and the back center panel 5 and the plurality of fabric pieces is irregular, meaning that the seams 24, 25, 26 and 27 between the non-stretch 6 and 28 and stretch 4 and 5 portions of the body 7 of the bra are non-linear. This irregular border 24, 25, 26 and 27 allows the amount of support to be greater where the non-stretch protrusions 12 of fabric are closer together and the amount of stretch to be greater where the non-stretch protrusions 13 of fabric are farther apart, providing additional breast tissue support without decreasing ventilation. It is within the scope of the present invention that the shape of the irregular border 24, 25, 26 and 27 can vary to include a variety of shapes and designs.

In still other embodiments of the present invention, the stretch fabric used for the back center panel 5 and/or front center panel 4 of the bra is a stretch mesh fabric. It is understood by those with ordinary skill in the art that the use of a stretch mesh fabric will provide a high degree of ventilation and moisture management without sacrificing motion control of the breast tissue.

Figure 8:
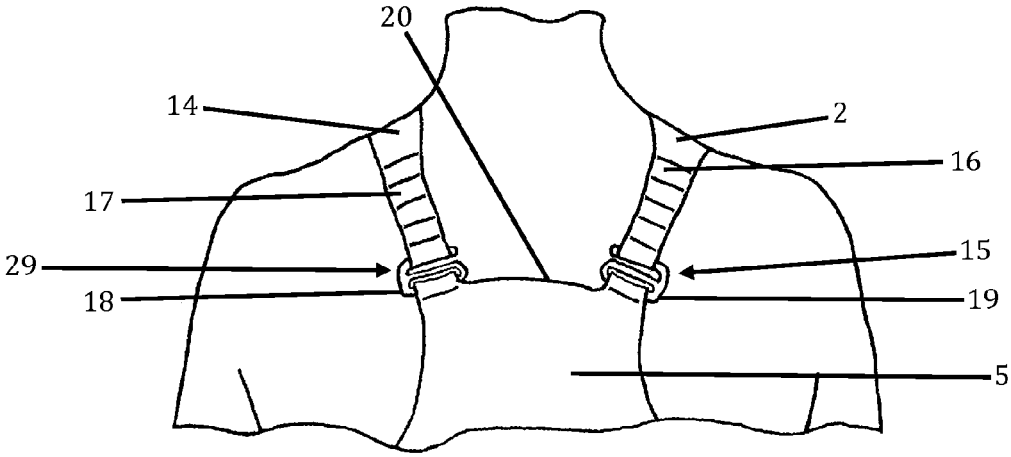
FIG. 8 is a rear elevational view of a bra in accordance with the present invention showing a shoulder strap incorporating an adjustable fastening system.
Figure 10:
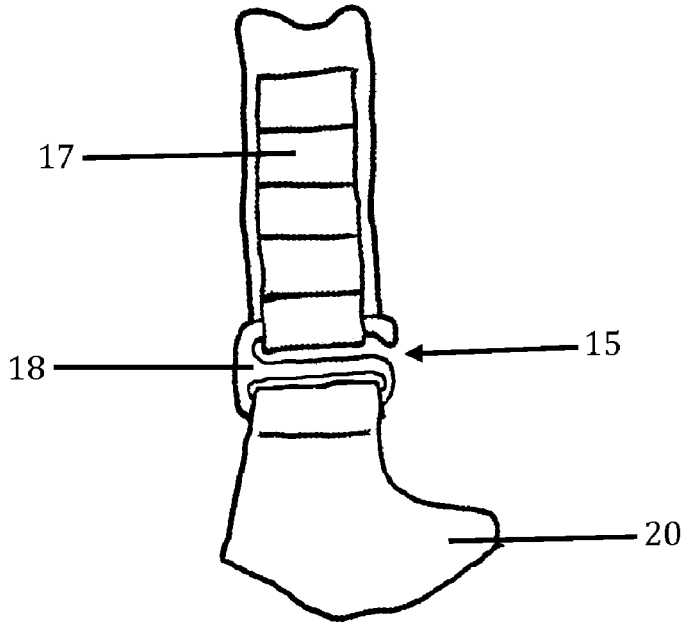
FIG. 10 is a detailed view of the adjustable fastening system according to FIG. 8.

In other embodiments of the present invention, the shoulder straps 2 and 14 include an adjustment fastening system 15 and 29. In the embodiment shown in FIG. 8 and FIG. 10, the adjustment fastening system 15 and 29 includes a series of slots 16 and 17 associated with each of the shoulder straps. Adjustment hooks 18 and 19 are associated with the top edge 20 of the back center panel 5. The adjustment hooks 18 and 19 are horizontally oriented so that they can be received in adjustment slots 16 and 17.

In other embodiments of the present invention, the adjustment fastening system 15 and 29 may include any kind of adjustment fastening system known in the art, such as Velcro or hook-and-eye.

Figure 7:
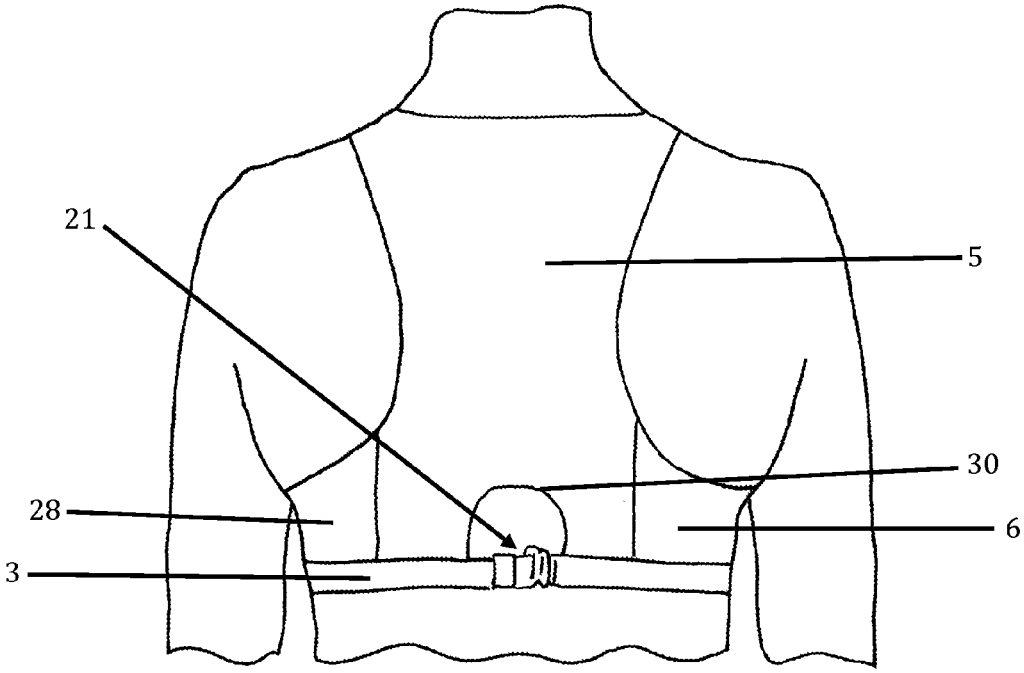
FIG. 7 is a rear elevational view of a bra in accordance with the present invention showing a rib band incorporating an adjustable fastening system.
Figure 9:
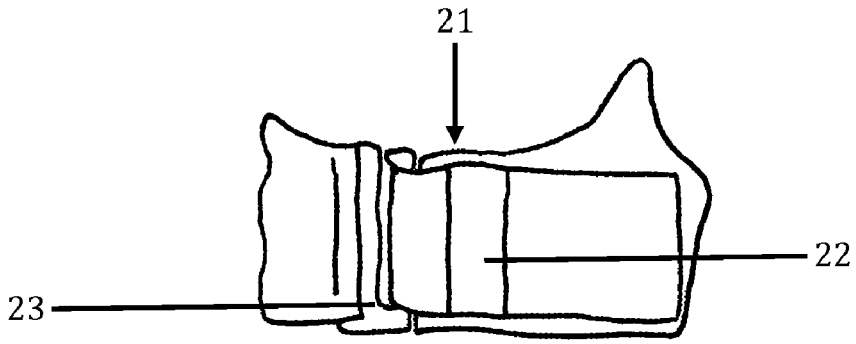
FIG. 9 is a detailed view of the adjustable fastening system according to FIG. 7.

In other embodiments of the present invention, the rib band 3 includes an adjustment fastening system 21. In the embodiment shown in FIG. 7 and FIG. 9, the adjustment fastening system includes a series of slots 22 associated with the rib band 3. An adjustment hook 23 is associated with one end of the rib band 3. The adjustment hook 23 is vertically oriented so that they can be received in adjustment slots 22. The back center panel 5 has a keyhole cutout 30 to accommodate adjustments made in the rib band 3.

The invention claimed is:

1. A bra comprising: a body configured to contact a wearer's torso; two shoulder straps connected to the body; and a rib band connected to the body and configured to encircle a wearer's torso; the body including a front center panel constructed of stretch material and having a left edge and a right edge; and a back center panel constructed of stretch material and having a left edge and a right edge; wherein the left edge of the front center panel and the right edge of the back center panel are connected to one another by one or more contiguous fabric pieces constructed of non-stretch material; and wherein the right edge of the front center panel and the left edge of the back center panel are connected to one another by one or more contiguous fabric pieces constructed of non-stretch material.

2. The bra of claim 1, wherein said rib band incorporates an adjustable fastening system.

3. The bra of claim 1, wherein at least one portion of the stretch fabric used for the body is mesh.

4. The bra of claim 3, wherein said rib band incorporates an adjustable fastening system.

5. The bra of claim 1, wherein the shoulder straps incorporate an adjustable fastening system.

6. The bra of claim 5, wherein at least one portion of the stretch fabric used for the body is mesh.

7. The bra of claim 5, wherein said rib band incorporates an adjustable fastening system.

8. The bra of claim 6, wherein said rib band incorporates an adjustable fastening system.

9. A bra comprising: a body configured to contact a wearer's torso; two shoulder straps connected to the body; and a rib band connected to the body and configured to encircle a wearer's torso; the body including a front center panel constructed of stretch material and having a left edge and a right edge; and a back center panel constructed of stretch material and having a left edge and a right edge; wherein the left edge of the front center panel and the right edge of the back center panel are connected to one another by one or more contiguous fabric pieces constructed of non-stretch material; and wherein the right edge of the front center panel and the left edge of the back center panel are connected to one another by one or more contiguous fabric pieces constructed of non-stretch material; wherein at least one seam between a panel constructed of stretch material and one of the fabric pieces constructed of non-stretch fabric is irregular.

10. The bra of claim 9, wherein said rib band incorporates an adjustable fastening system.

11. The bra of claim 9, wherein at least one portion of the stretch fabric used for the body is mesh.

12. The bra of claim 11, wherein said rib band incorporates an adjustable fastening system.

13. The bra of claim 9, wherein the shoulder straps incorporate an adjustable fastening system.

14. The bra of claim 13, wherein at least one portion of the stretch fabric used for the body is mesh.

15. The bra of claim 13, wherein said rib band incorporates an adjustable fastening system.

16. The bra of claim 14, wherein said rib band incorporates an adjustable fastening system.

* * * * *